US005986621A

United States Patent [19]

Barts et al.

[11] Patent Number: 5,986,621

[45] Date of Patent: Nov. 16, 1999

[54] STUB LOADED HELIX ANTENNA

[75] Inventors: R. Michael Barts, Christiansburg; Warren L. Stutzman, Blacksburg, both of Va.

[73] Assignee: Virginia Tech Intellectual Properties, Inc., Blacksburg, Va.

[21] Appl. No.: 08/888,324

[22] Filed: Jul. 3, 1997

[51] Int. Cl.[6] ..... H01Q 1/36

[52] U.S. Cl. ..... 343/895; 342/417; 343/881; 343/741

[58] Field of Search ..... 343/895, 796, 343/868, 749, 850, 829, 846, 866, 732, 741; 342/417

[56] References Cited

U.S. PATENT DOCUMENTS

| | | | |
|---|---|---|---|
| 2,495,399 | 9/1950 | Wheeler | 343/742 |
| 3,524,193 | 8/1970 | Auletta | 343/895 |
| 3,716,861 | 2/1973 | Root | 343/741 |
| 4,475,111 | 10/1984 | Gittinger et al. | 343/895 |
| 5,146,234 | 9/1992 | Lalezari | 343/895 |
| 5,162,806 | 11/1992 | Monser | 343/753 |
| 5,313,216 | 5/1994 | Wang et al. | 343/700 MS |
| 5,341,148 | 8/1994 | Walter et al. | 343/742 |
| 5,346,300 | 9/1994 | Yamamoto et al. | 343/895 |
| 5,349,365 | 9/1994 | Ow et al. | 343/898 |
| 5,359,340 | 10/1994 | Yokota | 343/792 |
| 5,450,093 | 9/1995 | Kim | 343/895 |
| 5,457,469 | 10/1995 | Diamond et al. | 343/730 |
| 5,517,206 | 5/1996 | Boone et al. | 343/806 |

*Primary Examiner*—Don Wong
*Assistant Examiner*—James Clinger
*Attorney, Agent, or Firm*—Whitham, Curtis & Whitham

[57] ABSTRACT

A helical antenna having stubs spaced along the helix curve length and extending toward the central axis of the helix, such that the performance characteristics of the antenna, such as gain and circular polarization, are maintained while the size of the antenna—diameter and length—are reduced.

16 Claims, 3 Drawing Sheets

STUB LOADED HELIX ANTENNA

BACKGROUND OF THE INVENTION

1. Field of the Invention

The present invention generally relates to helical antennas, and more particularly to helical antenna geometries which support reduced antenna size.

2. Background Description

The helical antenna is old in the art, having first appeared in the late 1940's. In a helical configuration, a length of conducting material is wound at a radius and with a pitch angle around a central axis. The radius of curvature of the helix is defined by the radius of the enclosing cylinder. The helix antenna produces a directional antenna pattern, generates circularly polarized radio waves, and has a wide operational frequency bandwidth.

In certain communication applications the antenna may be the largest component of the system. Thus there is a need for a way to reduce antenna size without reducing antenna performance.

SUMMARY OF THE INVENTION

It is therefore an object of the present invention to reduce antenna size without reducing antenna performance.

The present invention is an improved geometry for a helical antenna. Along its length are a plurality of stubs which project from the outer radius of curvature of the helix toward the central axis of the helix. The stubs are not in electrical contact with one another. The stub loaded helical geometry is defined by a) the circumference of the helix (which is $2\pi$ times the radius of the enclosing cylinder), b) the number of turns of the helix, c) the pitch angle of the helical windings, d) the number of stubs per turn, e) the depth of the stubs, and f) the angular width of each stub (i.e. the angle subtended by the width of the stub at the radius of the enclosing cylinder). A stub loaded helix antenna in accordance with the invention exhibits performance characteristics such as gain and circular polarization similar to the traditional helical antenna, but is approximately one third smaller in diameter and one-half as long. The stub loaded helix antenna can be used in wireless local area networks, satellite communications, microwave point-to-point systems, and personal communication systems. The antenna is most useful in applications which use frequencies from the low VHF to low microwave range.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
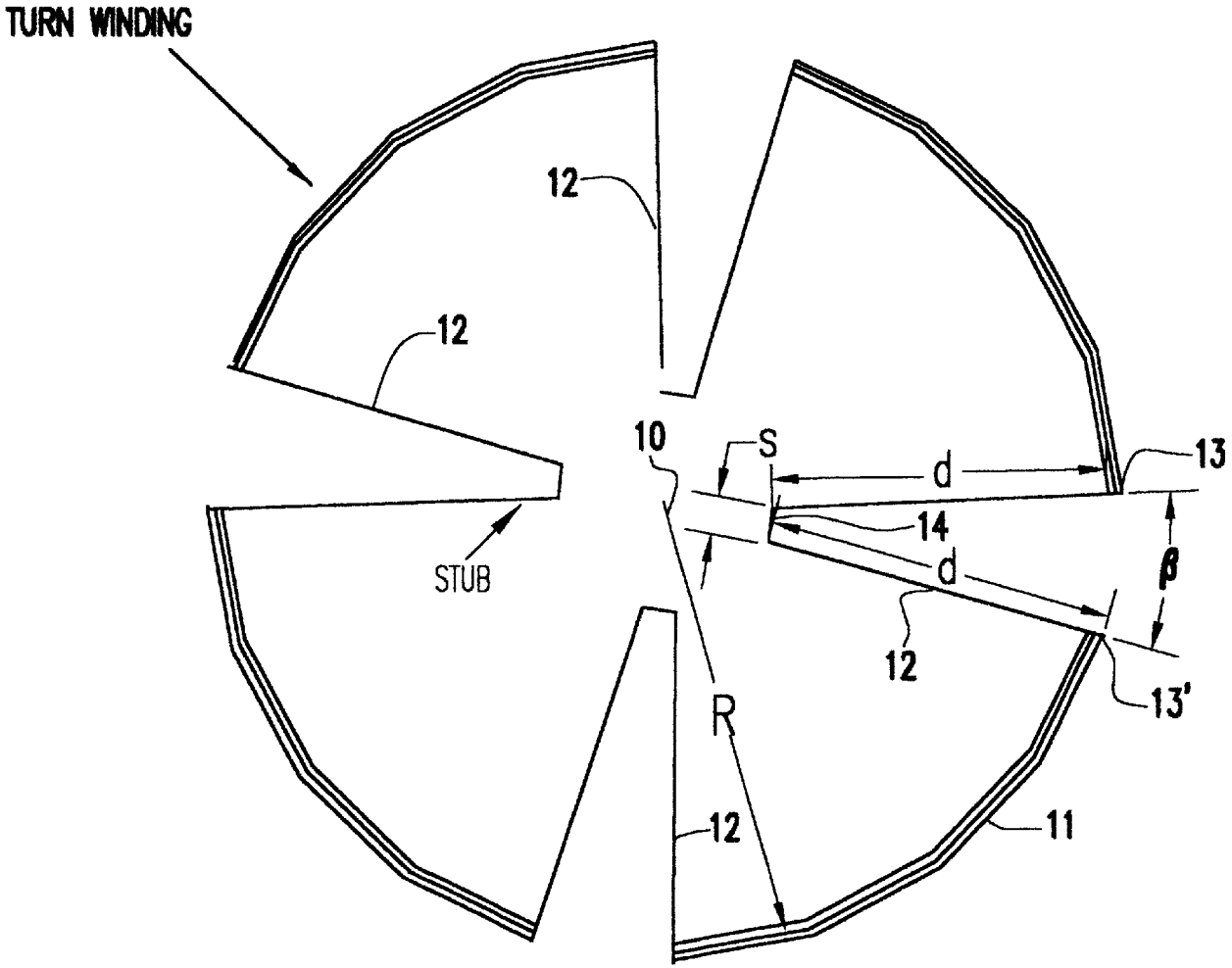
FIG. 1 is a top view of a single turn of a stub loaded helix antenna.

Referring now to the drawings, and more particularly to FIG. 1, there is shown a top view of a single turn of a stub loaded helix antenna. The antenna is formed from a continuous length of conducting material.

Figure 3:
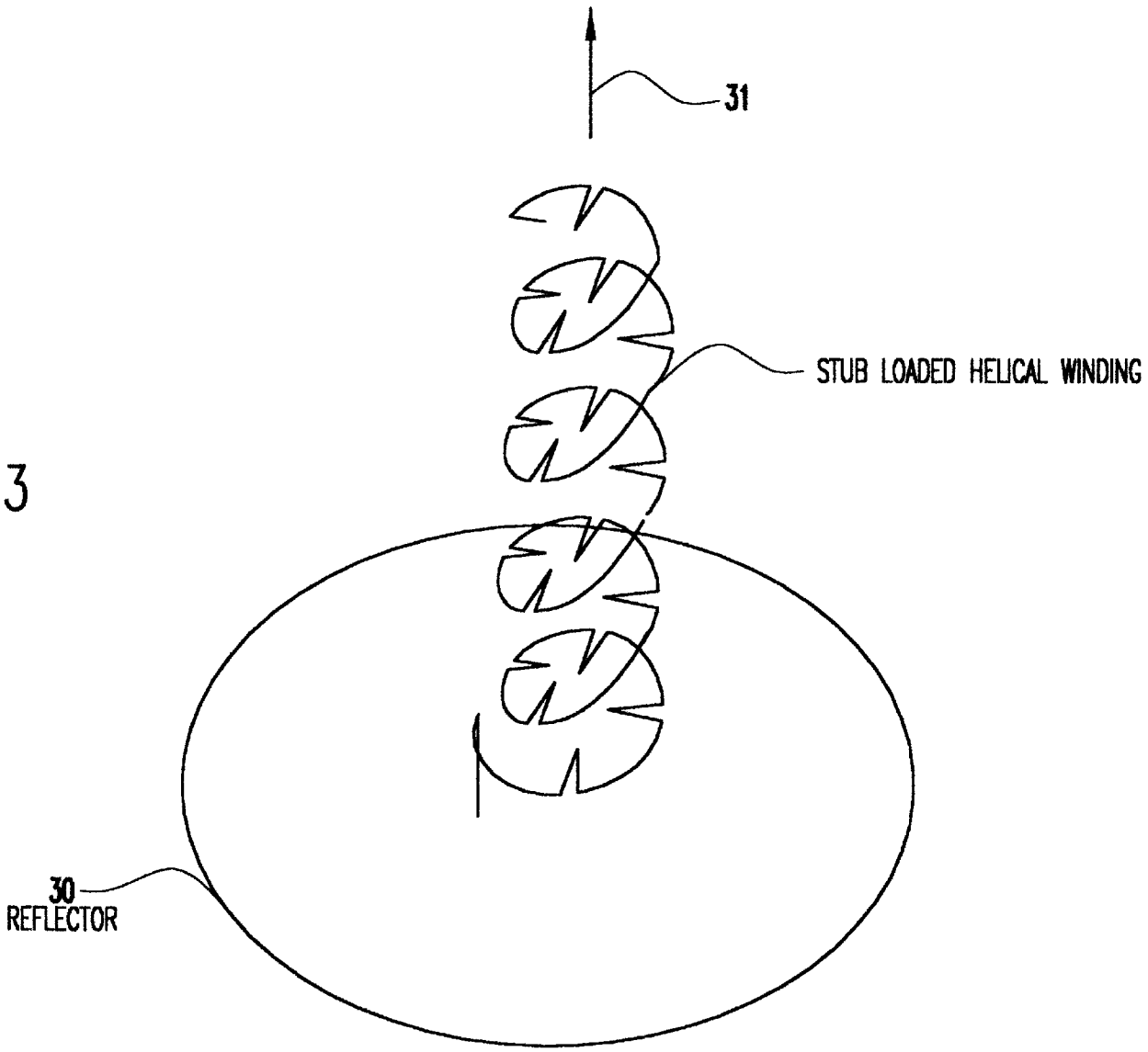
FIG. 3 is an oblique view of a stub loaded helix antenna.

The distance from the center 10 to the circumference 11 of the enclosing cylinder of the helix is a radius "R" (hereinafter called "radius of the helix" or "helix radius"). The diameter "D" of the helix is the diameter (2R) of the enclosing cylinder, and the circumference of the enclosing cylinder is "C". The helical shape is a continuous curve, and along the length of that continuous curve (hereinafter "curve length of the helix" or "helix curve length") the distance around one turn of the helix is $$T_d = \frac{C}{\cos(\alpha)}$$

where $C=\pi D$ and $\alpha$=pitch angle between successive turns of the helix. Each stub 12 (four are shown in this example) is formed by bending the conducting material at approximately right angles from the circumference at points 13 and 13' toward the center 10 extending a distance "d", less than radius "R". The angular width $\beta$ of the stub 12 is the angle subtended by the arc defined by the width of the stub at the radius of the enclosing cylinder (i.e. between points 13 and 13'). For each turn of the helix there are a number ("n") of stubs 12 extending from the circumference 11 along the helix curve length. In the example shown, n =4 and each stub has a depth of about two thirds of a radius and is truncated in a side 14 of length "s". In general "n" need not be an integer, nor need it be the same from turn to turn, although it would be the same in typical implementations. Typically, as well, "s" would be less than the width of the stub at the radius, and could be zero so that the stub end in the direction of the center axis is pointed (as indicated in FIG. 3).

Figure 2:
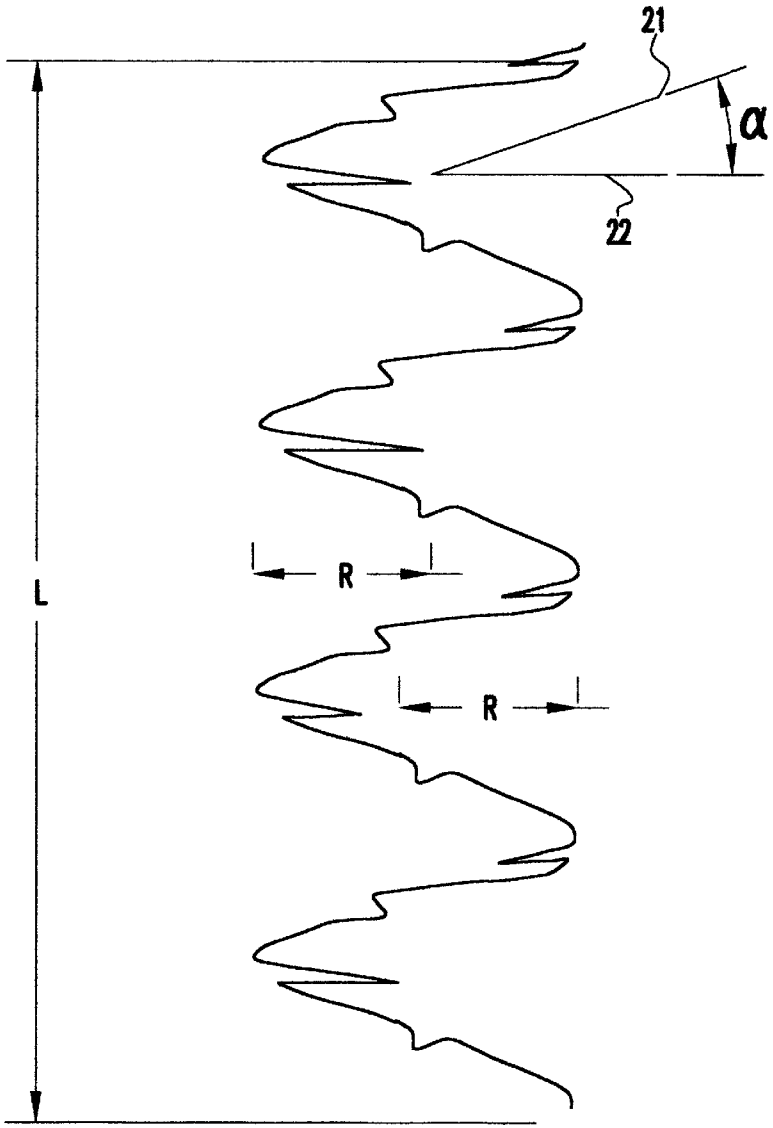
FIG. 2 is a side view of a four turn stub loaded helix antenna.

Turning now to FIG. 2 there is shown a side view of a stub loaded helix antenna. The helix has a pitch angle a, which is measured by taking a tangent 21 along the helix curve length and, at the point where the tangent meets the enclosing cylinder defined by the helix, taking another tangent 22 which lies in a plane perpendicular to the central axis of the helix. If the length of the central axis of the helix is "L" and the length of a single helical turn without stubs is "$T_d$", then $$L = NT_d \sin\alpha = N\frac{C}{\cos\alpha}\sin\alpha = NC\tan\alpha$$

where "N" is the number of turns in the helix.

The actual length of conductor in a single turn of the stub loaded helix antenna is not "$T_d$" (which is the length of a helical turn without stubs). From "$T_d$" there must be subtracted the length corresponding to the angular width of the stubs (yielding an angular component of $2\pi-n\beta$), and then there must be added the length of conductor taken by the stubs. In the example shown in FIG. 1, the conductor length taken by each stub is $$S_L=(2d+s)$$

Therefore, the length of conductor for each turn of the stub loaded helix antenna is $$T_L = \frac{(2\pi - n\beta)R}{\cos\alpha} + nS_L$$

where $S_L \geqq 2d$.

FIG. 3 shows an oblique view of an antenna in accordance with the invention, having a stub loaded helical winding mounted on a reflector 30 in the conventional manner, with the central axis 31 of the helix being along the beam axis of the reflector. In a typical implementation of the preferred embodiment of the invention, which achieves size reductions of about one-third in diameter and one-half in length over a conventional helix antenna with comparable performance characteristics such as gain and circular polarization, preferably the pitch angle is in the range of 7° to 9°, the number of stubs per turn may range from 3 to 15, the number of turns may range from 4 to 10, and the depth of stubs may range from two-thirds to three-quarters of a helix radius. Other embodiments of the invention may show different, yet still significant, levels of size reduction over a conventional helix antenna having comparable performance characteristics.

While the invention has been described in terms of a preferred embodiment, those skilled in the art will recognize that the invention can be practiced with modification within the spirit and scope of the appended claims.

Having thus described our invention, what we claim as new and desire to secure by letters patent is as follows:

1. An antenna, comprising:

a continuous length of conductive material formed in the shape of a helix and having a plurality of stub regions along a curve length of said helix which extend towards a central axis of said helix, said helix having a non-zero pitch angle.

2. The antenna of claim 1, wherein said helix is comprised of a plurality of turn windings arranged at a pitch angle around said axis, each of said turn windings having at least one of said stub regions spaced along said curve length.

3. The antenna of claim 2, wherein each of said stub regions projects toward said axis to a depth less than a radius of said helix.

4. The antenna of claim 3, wherein said stub depth is between two-thirds and three-fourths of said helix radius.

5. The antenna of claim 4, wherein said pitch angle is in the range of 7° to 9°.

6. The antenna of claim 5, wherein the number of turn windings is in the range of 3 to 15.

7. The antenna of claim 6, wherein the number of stubs per turn is in the range of 4 to 10.

8. The antenna of claim 3, having four stubs for each of said turn windings, each said stub having a depth of approximately three-fourths of said helix radius.

9. The antenna of claim 3, wherein each of said stubs has a width at said helix curve length and is truncated towards said center of said helix in a side having a length less than said width.

10. The antenna of claim 9, wherein said length of said side is zero.

11. The antenna of claim 10, additionally comprising a reflector, wherein said helix is mounted on said reflector, and wherein said center axis of said helix is along a beam axis of said reflector.

12. An antenna, comprising:

a continuous length of conductive wire wound around a plurality of turns in a cylinder shape forming a helix having a non-zero pitch angle $\alpha$, a circumference of said helix being $2\pi$ times a radius of said cylinder shape; and a plurality of wedge-shaped stub regions formed along said continuous length of said conductive wire directed toward a center axis of said helix, said plurality of wedge-shaped stub regions having a depth less said radius of said cylinder shape.

13. An antenna as recited in claim 12, further comprising a flat truncated portion an a far end of said plurality of wedge-shaped stub regions.

14. An antenna as recited in claim 12 wherein a number of said wedge-shaped stub regions per turn is in a range 4 to 10, wherein said pitch angle a is in the range of 7° to 9°, and wherein the number of turns is in the range of 3 to 15.

15. An antenna as recited in claim 12 wherein each of said wedge-shaped stub regions has a depth of approximately three-fourths of said cylinder radius.

16. An antenna as recited in claim 12 further comprising a reflector, wherein said helix is mounted on said reflector, and wherein a center axis of said helix is along a beam axis of said reflector.

* * * * *